US010446923B2

(12) United States Patent
Watson

(10) Patent No.: US 10,446,923 B2
(45) Date of Patent: Oct. 15, 2019

(54) ANTENNA ARRAY WITH REDUCED MUTUAL COUPLING EFFECT

(71) Applicant: Paul Robert Watson, Kanata (CA)

(72) Inventor: Paul Robert Watson, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 682 days.

(21) Appl. No.: 14/984,831

(22) Filed: Dec. 30, 2015

(65) Prior Publication Data

US 2017/0194703 A1 Jul. 6, 2017

(51) Int. Cl.
*H01Q 1/52* (2006.01)
*H01Q 21/06* (2006.01)

(52) U.S. Cl.
CPC ..... *H01Q 1/523* (2013.01); *H01Q 21/065* (2013.01)

(58) Field of Classification Search
CPC ..... H01Q 1/52–1/525; H01Q 21/065; H01Q 21/00; H01Q 1/38
See application file for complete search history.

(56) References Cited

U.S. PATENT DOCUMENTS 4,047,156 A * 9/1977 Atkins ..... G06K 7/086 331/117 R
6,262,495 B1 * 7/2001 Yablonovitch ..... H01Q 1/48 307/101
7,006,794 B1 * 2/2006 Lockie ..... H04B 7/0408 455/62
7,079,079 B2 * 7/2006 Jo ..... H01Q 1/243 343/700 MS
9,979,072 B2 * 5/2018 Choi ..... H01Q 1/2216
2003/0164797 A1 * 9/2003 Ngai ..... H01Q 1/523 343/700 MS
2004/0160367 A1 * 8/2004 Mendolia ..... H01Q 1/521 343/700 MS
2005/0030246 A1 2/2005 Durham et al.
2007/0069968 A1 * 3/2007 Moller ..... H01Q 9/285 343/795
2009/0160729 A1 * 6/2009 Hunt ..... H01Q 1/246 343/893

(Continued)

FOREIGN PATENT DOCUMENTS

CN 1860648 A 11/2006
EP 0847101 A2 6/1998

OTHER PUBLICATIONS

International Search Report for International Application No. PCT/CN2016/076772 dated Sep. 21, 2016.

*Primary Examiner* — Dameon E Levi
*Assistant Examiner* — Hasan Z Islam

(57) ABSTRACT

A mutual coupling reduction circuit is provided for an antenna array. The antenna array includes first and second antenna elements having first and second radiating bodies, respectively. The mutual coupling reduction circuit is disposed between the first and second radiating bodies to reduce mutual coupling between the antenna elements. Multiple mutual coupling reduction circuits may be provided between multiple radiating bodies. The impedance of the mutual coupling reduction circuit is configured to reduce the mutual coupling. The mutual coupling reduction circuit may be disposed in parallel with a polarization of the antenna elements.

26 Claims, 12 Drawing Sheets

(56) References Cited

U.S. PATENT DOCUMENTS

| | | | | |
|---|---|---|---|---|
| 2014/0203995 | A1* | 7/2014 | Romney | H01Q 19/17<br>343/893 |
| 2015/0138032 | A1* | 5/2015 | Yona | H01Q 1/521<br>343/816 |
| 2016/0141748 | A1* | 5/2016 | Tagi | H01Q 1/38<br>342/175 |

* cited by examiner

ANTENNA ARRAY WITH REDUCED MUTUAL COUPLING EFFECT

FIELD OF THE INVENTION

The present invention generally relates to antennas for radio communications, and in particular to an antenna array with a reduced mutual coupling effect.

BACKGROUND

Antenna arrays comprise an arrangement of individually radiating antenna elements for application in radio communication devices, such as wireless access points, routers and base stations, potentially along with user equipment devices such as cellular phones, laptops, and tablets. Certain operations, such as beam-steering, utilize selective operation of the phase and amplitude relationships between individual antenna elements for improving transmission and reception characteristics of the antenna array. Densely packed antenna arrays, potentially with large numbers of elements such as in Massive MIMO systems, can lead to situations in which antenna elements are situated very close to one another. Such dense arrays may be required to enable beam steering over an adequate angular range, for example. Size reduction trends and operation in higher radio frequency bands also encourage reduced spacing between antenna elements. Unfortunately, as the spacing between individual antenna elements in an antenna array becomes narrower, the mutual coupling effect between the individual elements becomes more pronounced and problematic. Mutual coupling is a typically undesired phenomenon that affects the impedance characteristics of the individual antenna elements, results in absorption of energy by nearby antenna elements, and distorts radiation and transmission patterns. Accordingly, an antenna array that reduces the effect of mutual coupling is desired.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present invention is to provide an improved antenna array. In certain embodiments, the antenna array may reduce the mutual coupling effect between individual antenna elements.

In accordance with embodiments of the present invention, there is provided an antenna array including a body, a first antenna element, a second antenna element and a mutual coupling reduction circuit. The first antenna element includes a first radiating body disposed on the body and the second antenna element includes a second radiating body disposed on the body. The mutual coupling reduction circuit couples the first and second radiating bodies to reduce a mutual coupling effect between the first and second antenna elements.

In accordance with other embodiments of the present invention, there is provided a method for manufacturing an antenna array. The antenna array includes a body, a first antenna element having a first radiating body, a second antenna element having a second radiating body, and a mutual coupling reduction circuit. The method includes disposing the first and second radiating bodies on the body and coupling the mutual coupling reduction circuit between the first and second radiating bodies to reduce a mutual coupling effect between the first and second antenna elements.

BRIEF DESCRIPTION OF THE FIGURES

Further features and advantages of the present invention will become apparent from the following detailed description, taken in combination with the appended drawings, in which:

FIG. 1(*b*) illustrates lines of symmetry of the antenna array of FIG. 1(*a*).

FIG. 5(*b*) is a chart illustrating simulated effect of mutual coupling on the antenna array of FIGS. 3-4 after the inclusion of mutual coupling reduction circuits.

FIG. 6(*b*) is a chart illustrating a simulated azimuth cut of a radiation pattern of the antenna array of FIGS. 3-4 after the inclusion of mutual coupling reduction circuits.

FIG. 7(*b*) illustrates an antenna array or portion thereof, in accordance with an embodiment of the present invention.

It will be noted that throughout the appended drawings, like features are identified by like reference numerals.

DETAILED DESCRIPTION

Mutual coupling is a typically detrimental effect between antenna elements caused by unwanted energy absorption from nearby antenna elements during antenna operation. The effect of mutual coupling becomes more pronounced in antenna arrays having closely spaced antenna elements, as energy intended to be radiated away from one antenna element, becomes absorbed by another nearby antenna element. Similarly, energy which should be captured by a particular antenna element is instead absorbed by another nearby antenna element. Accordingly, mutual coupling reduces the efficiency and performance of the antenna array in both transmission and reception. In many situations, mutual coupling also serves to perturb individual antenna element patterns, and also perturbs element excitations due to active impedance, and therefore degrades the resultant antenna array pattern. Mutual coupling may perturb antenna element operating characteristics, thereby potentially leading to performance degradation. Embodiments of the present invention seek to address one or more of these problems by providing an antenna array that at least partially reduces the effect of mutual coupling.

Figure 1A:
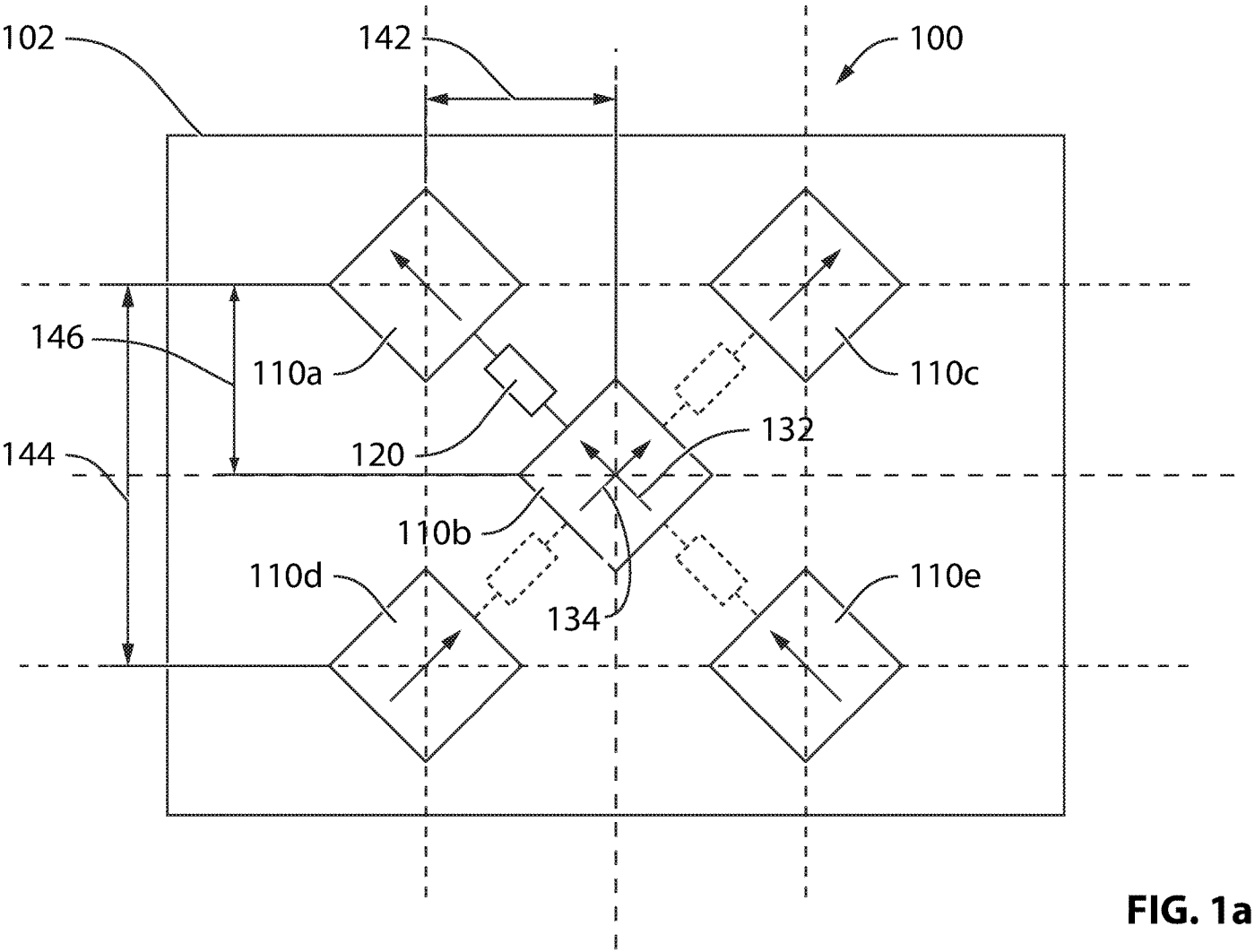
FIG. 1(*a*) illustrates a plan view of an antenna array, according to an embodiment of the present invention.
Figure 1B:
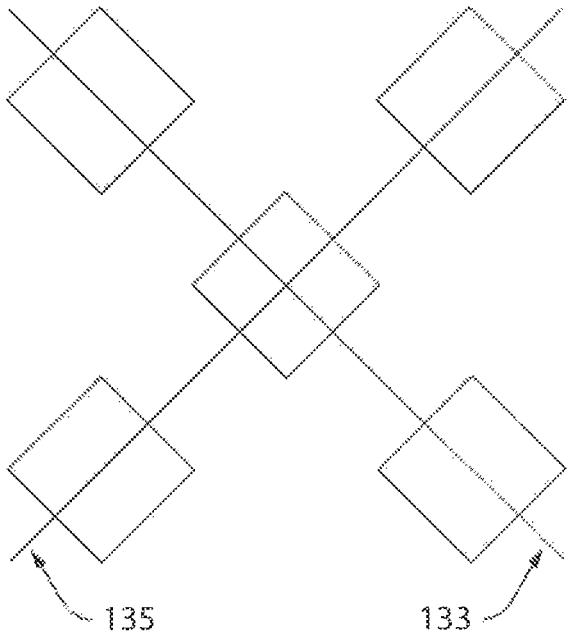

Referring to FIG. 1(*a*), there is shown an embodiment of an antenna array 100 or portion thereof comprising a plurality of antenna elements each having respective radiating bodies 110*a*-110*e* disposed on a body 102, which physically supports the radiating bodies. The radiating bodies may be radiating bodies of planar patch antennas being fed from below by feed probes, for example. Each radiating body 110*a*-110*e* is arranged on the body 102 in a symmetrically staggered configuration and oriented relative to both a first direction 132 and a second direction 134. As shown in FIG. 1(*a*), vertically adjacent radiating bodies (second radiating body 110*b* in center of array 100 excluded) are separated by vertical spacing 144, while horizontally adjacent radiating bodies (second radiating body 110*b* in center of array 100 included) are separated by horizontal spacing 142. A mutual coupling reduction circuit 120 is coupled between a first radiating body 110*a* and a second radiating body 110*b* to reduce mutual coupling therebetween, as discussed further below. As used herein, the terms "horizontal" and "vertical" are relative terms, and do not necessarily reflect orientation relative to an external frame of reference.

Figure 7A:
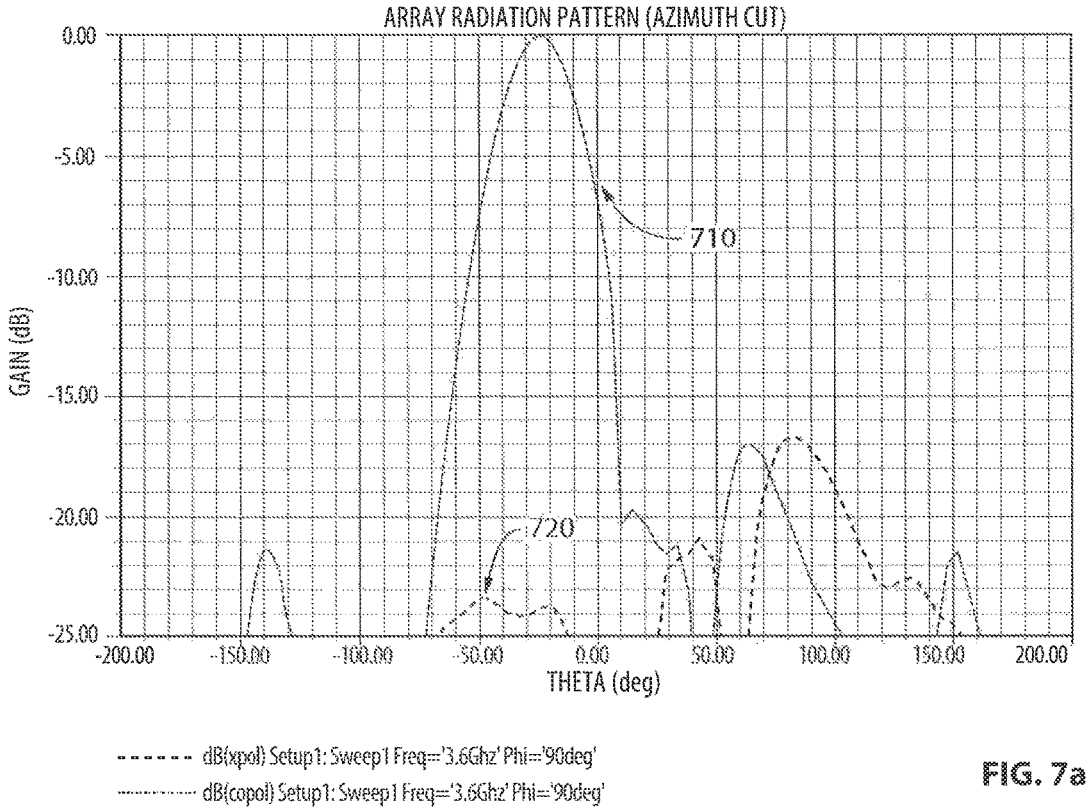
FIG. 7(*a*) is a chart illustrating an azimuth cut of a simulated radiation pattern of an antenna array, in accordance with an embodiment of the present invention.
Figure 7B:
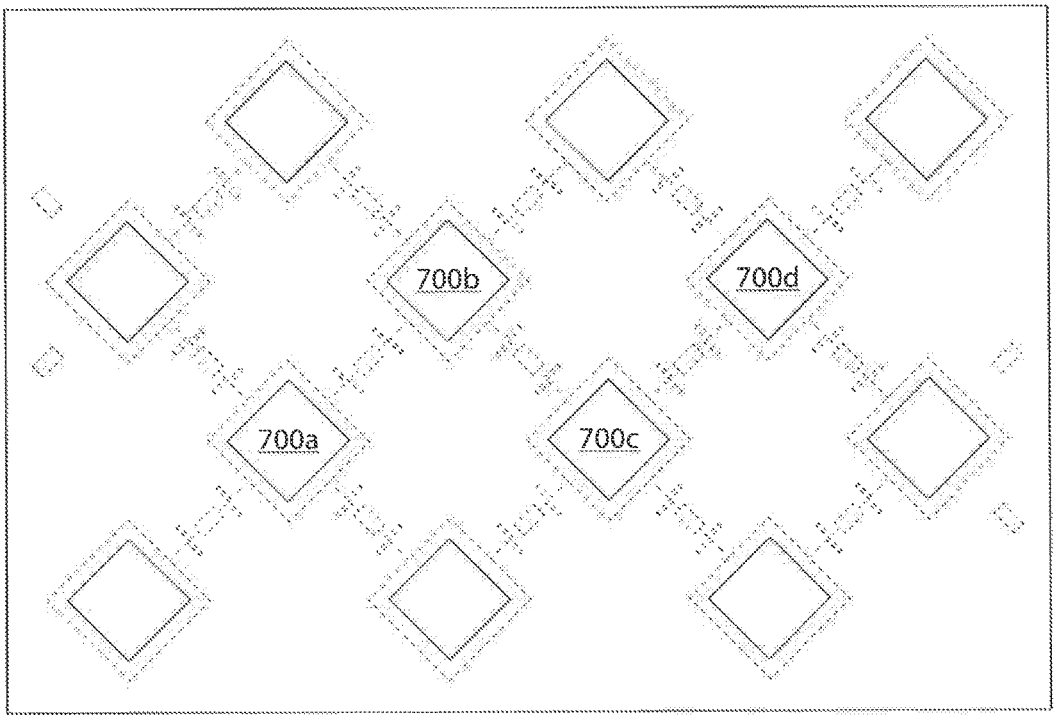

In various embodiments, the antenna array is formed of first and second interleaved rectangular grids of antenna elements. Each rectangular grid includes antenna elements spaced at regular intervals in the horizontal and vertical directions. The elements of the second rectangular grid are disposed at or near a center point of four adjacent elements of the first rectangular grid. As such, the second rectangular grid is diagonally offset from the first rectangular grid with respect to the horizontal and vertical directions. The second rectangular grid may include a single element or multiple elements. With respect to FIG. 1(*a*), radiating bodies 110*a* and 110*c* to 110*e* correspond to elements of the first rectangular grid and radiating body 110*b* corresponds to an element of the second rectangular grid. As illustrated, the edges of the rectangular radiating bodies may be oriented diagonally to the (horizontal and vertical) gridlines of the two rectangular grids. The two rectangular grids may have parallel sets of gridlines. Other arrangements may be provided, for example in which three or more rectangular grids of antenna elements are interleaved. FIG. 7(*b*) illustrates two interleaved rectangular grids, each grid having multiple antenna elements.

As an alternative description, and in some embodiments, the antenna array may include a set of staggered columns of antenna elements. Each column includes a linear arrangement of antenna elements, and the columns are substantially parallel to one another. However, adjacent columns are diagonally offset from each other. In one embodiment, the columns have a vertical element pitch 144 of Y mm, and the columns are offset horizontally by a distance 142 of about X=Y/2 mm. and the adjacent columns may be offset 146 by deltaY=Y/2 mm. In some embodiments, the distance X may take on values other than Y/2.

In various embodiments, each antenna element is associated with two polarizations, namely a polarization along the first direction 132 and a polarization along the second direction 134. The antennas may be differentially driven so as to operate with one or a combination of the two polarizations. The polarizations within each element (e.g. polarizations along directions 132 and 134) may be substantially isolated from one another as well as substantially orthogonal. It is observed herein that mutual coupling between adjacent antenna elements may be strongest in the direction of an operative polarization of one or both of the adjacent antenna elements. This can be particularly true when the antenna elements are co-polarized. As such, in various embodiments, instances of the mutual coupling reduction circuit can be placed between adjacent antenna elements which exhibit relatively high mutual coupling, due to one or both of proximity and polarization. A mutual coupling reduction circuit may be placed between all adjacent radiating bodies, or between one or more selected pairs of radiating bodies, such as adjacent radiating bodies. Each mutual coupling reduction circuit 120 may be directly conductively coupled to a pair of radiating bodies. In the illustrated embodiment, the rectangular antenna elements have edges which are parallel with the first and second directions 132, 134.

The mutual coupling reduction circuit 120 comprises a network for resonating with the mutual coupling between adjacent radiating bodies. In some embodiments, the coupling reduction can be characterized in terms of the known nomenclature of S-parameters. In particular, let $S_{21}$ denote the strength of coupling between an input to a probe feed of a first one of the antenna elements and output from a probe feed of a second, adjacent one of the antenna elements. These may, for example, be the antenna elements corresponding to patch radiating bodies 110*a* and 110*b* in FIG. 1(*a*). The mutual coupling reduction circuit 120 tends to introduce a reduction in the magnitude of the $S_{21}$ parameter for at least a frequency range which includes operating frequencies of the antenna elements. By reducing the interaction between two antenna element radiating bodies, mutual coupling is reduced, at the operating frequency, to thereby permit close-proximity spacing of radiating bodies 110*a*, 110*b* within antenna array 100.

In certain embodiments, the mutual coupling reduction circuit 120 may form part of a parallel resonating circuit which exists between the first radiating body 110*a* and the second radiating body 110*b*. The parallel resonating circuit includes two parallel branches: the circuit 120 as a first branch, and a capacitive air interface as a second branch. The capacitive air interface can be conceptualized as a capacitive circuit branch located between the first radiating body 110*a* and the second radiating body 110*b*. The capacitive air interface is one example of an electrical, magnetic, and/or electromagnetic coupling which inherently exists between antenna elements, due to proximity, orientation, intervening materials, and the like. In some embodiments, a mutual coupling reduction circuit 120 is connected between antenna element radiating bodies, in parallel with a capacitive air interface or the like. The mutual coupling reduction circuit 120 can be selected so as to provide overall electrical characteristics which inhibit antenna element mutual coupling.

In some embodiments, the mutual coupling reduction circuit 120 may comprise an inductor in parallel with the capacitive air interface that resonates in between the first and second radiating bodies 110*a*, 110*b*. In other embodiments, the mutual coupling reduction circuit 120 may comprise capacitor, an inductor-capacitor (LC) circuit, or an inductor-capacitor-inductor (LCL) circuit or capacitor-inductor-capacitor (CLC) circuit which enhances symmetry between the first and second radiating bodies 110*a*, 110*b*. The inductance and/or capacitance values of the mutual coupling reduction circuit 120 may be selected to tune the circuit at specific operating frequencies, and to limit, reduce or minimize the effect of mutual coupling. The topology of the mutual coupling reduction circuit, for example whether it includes a capacitor and an inductor in series or in parallel, may also be selected to provide for a desired operation of the overall mutual coupling reduction circuit. Inductance and capacitance value selection and/or circuit topology selection can be performed, for example, through electronic circuit simulation of the antenna array 100.

In various embodiments, the mutual coupling reduction circuit 120 is configured to provide for a particular electrical filtering aspect which inhibits mutual coupling between a pair of antenna elements. The electrical filter is provided by a resonating circuit, one branch of which corresponds to the mutual coupling reduction circuit. The filtering characteristics of the resultant resonating circuit can be configured, through inductance and capacitance value selection and/or circuit topology selection. Relevant configurable filtering characteristics may include filter center frequency, filter attenuation, filter bandwidth, filter Q, and the like.

In some embodiments, the coupling between adjacent elements can be a combination of: coupling between patches; and coupling between patch feed structures. The coupling between patches may be the predominant mode of coupling.

In one embodiment, instead of using feed probes, patches can be excited by coupling with radiating slots in a conductive 'reflector' 102. In such embodiments, the mutual coupling reduction circuit may be configured having a different topology and/or impedance than when feed probes are used. More generally, the mutual coupling reduction circuit may be configured taking into account various characteristics of the antenna array, including feed structure and radiating body type, shape, topology, inter-element spacing, and relative arrangement.

In some embodiments, the impedance of the mutual coupling reduction circuit may be configured based at least in part on the spacing between antenna elements. In some embodiments the impedance of the mutual coupling reduction circuit may be configured based at least in part on the antenna element structure including the feed network.

In various embodiments, the mutual coupling reduction circuit is placed along the plane of polarization of the antenna elements, and is connected to the patch radiating bodies of adjacent antenna elements at the centre of the patch edges. Connection may include conductive connection using a copper trace, or a capacitive connection using a parallel plate capacitor disposed at least partially over the patch. This arrangement may facilitate cross polarization discrimination of the antenna elements and/or antenna array.

Referring again to FIG. 1(*a*), while antenna elements are depicted as patch antennas, with radiating bodies 110*a*-110*e* comprising respective patches, in other embodiments (not shown), antenna elements may comprise other suitable antenna structures such as dipoles, wire antennas, reflector antennas, micro-strip antennas, and the like. A patch antenna may include multiple patches situated one above the other. Patch elements may be probe fed, capacitive patch fed, or slot coupled fed, for example.

Further, radiating bodies 110*a*-110*e* are depicted as co-oriented in a first direction 132 of −45°, and a second direction 134 of +45°, with respect to the vertical edge of the body 102; this permits operation of the antenna elements with a common polarization of −45° or +45° to maintain good cross polarization discrimination. However, in other embodiments (not shown), the first and second directions 132, 134 may comprise different angles with respect to the body 102, for operation of the antenna elements at different polarization vectors.

Moreover, while FIG. 1(*a*) depicts the mutual coupling reduction circuit 120 disposed between the first and second radiating bodies 110*a*, 110*b* and oriented along the first direction. The mutual coupling reduction circuit 120 may be otherwise positioned and aligned in other embodiments (not shown). For example, the mutual coupling reduction circuit 120 may be offset from a line between the first and second radiating bodies 110*a*, 110*b*, and/or oriented at angles other than −45° or +45° from the vertical edge of the body 102.

In some embodiments, the antenna array may be rotated 45 degrees so that antenna array polarizations are along 0 and 90 degree directions with respect to an external world reference frame. The location of the mutual coupling reduction circuit along the polarization plane may assist in keeping these two antenna array polarizations isolated from one another. The arrangement of antenna elements, such as the spacing 142 in FIG. 1(*a*) being about half of the spacing 144, may also assist in keeping the two antenna array polarizations isolated from one another.

In one embodiment, the mutual coupling reduction circuit may be provided in the form of two or more parallel circuits. The parallel circuits may be coupled to an edge of an antenna element radiating body at two locations, which are positioned symmetrically about the center location of this edge of the radiating body.

For further clarity, FIG. 1(*b*) illustrates lines of symmetry 133, 135 of the antenna array of FIG. 1(*a*), according to an embodiment. The lines of symmetry are substantially parallel to the first and second directions 132, 134 and pass through a center of the central radiating body 110*b*. In a larger array, other local or global lines of symmetry may also be present. In various embodiments, the mutual coupling reduction circuits may be placed substantially along the lines of symmetry.

Further, while radiating bodies 110*a*-110*e* are shown in FIG. 1(*a*) in a symmetrically spaced configuration to promote cross polarization isolation and discrimination, and with second radiating body 110*b* centered between the radiating bodies 110*a*, 110*c*, 110*d*, 110*e* to promote tighter "packing", this configuration may vary in other embodiments (not shown). For example, other embodiments may comprise non-symmetrically spaced radiating bodies, and may or may not include a centered antenna element, such as the second radiating body 110*b* depicted in FIG. 1(*a*). Radiating bodies may be provided in a variety of sizes, shapes, spacings, and relative positions and orientations.

The vertical spacing 144 and horizontal spacing 142 between radiating bodies 110*a*-110*e* may also vary according to particular embodiments. In one embodiment, the vertical spacing 144 may comprise between 0.85λ and 1.15λ, and the horizontal spacing 142 is about 0.5λ, where λ is an operating wavelength of the antenna elements, such as a center wavelength of an operating range. However these dimensions may be changed to meet different design parameters of the antenna array 100.

As further shown in FIG. 1(*a*), adjacent radiating bodies have a 2:1 ratio (also potentially referred to as a 2λ:1λ ratio)vertical to horizontal (elevation to azimuth) spacing ratio to promote symmetry and placement of the mutual coupling reduction circuit 120 along the −45° or +45° symmetrical lines, again to help promote good cross polarization and isolation discrimination. However, the spacing ratio may vary accordingly in other embodiments. The two lines of symmetry may pass through the center of radiating body 110*b* at the point of intersection of direction arrows 132, 134. The two lines of symmetry may be substantially parallel to the two direction arrows 132, 134, thereby dividing the illustrated array portion into four substantially symmetrical quadrants. The mutual coupling reduction circuits may be placed substantially along the lines of symmetry. Moreover a mutual coupling reduction circuit placed along a line of symmetry may be substantially symmetric (e.g. mirror symmetric) about that line of symmetry.

Figure 2:
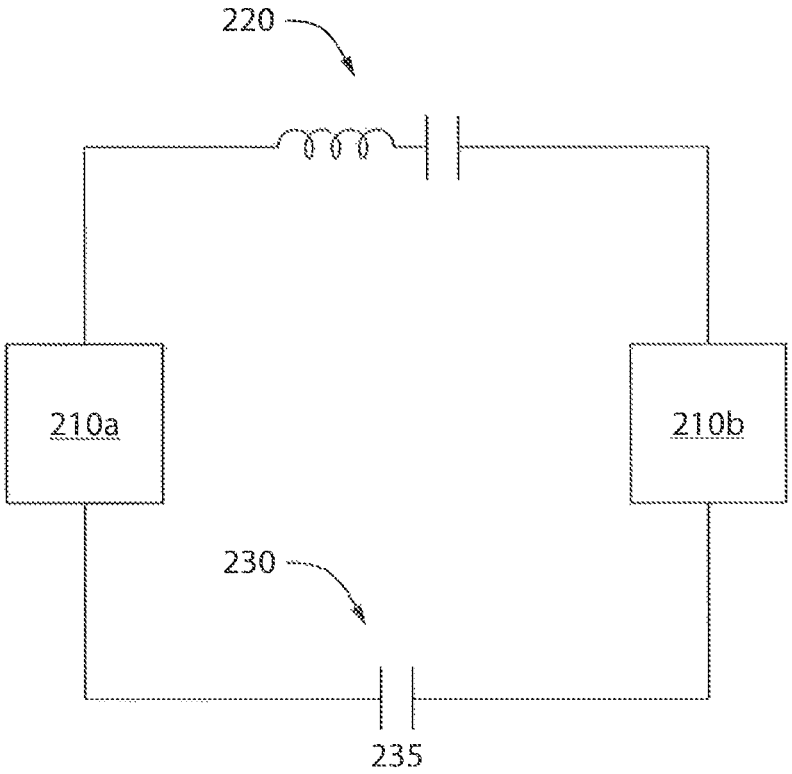
FIG. 2 schematically illustrates a resonating circuit between two antenna elements, according to an embodiment of the present invention.

FIG. 2 schematically illustrates a parallel resonating circuit coupled between two radiating bodies 210*a*, 210*b*, in accordance with embodiments of the present invention. The resonating circuit includes two parallel branches. The first branch corresponds to a mutual coupling reduction circuit 220, while the second branch 230 corresponds to existing inherent electrical coupling between the two radiating bodies, for example due to coupling via a capacitive air interface. The first branch is provided and may be electrically conductively coupled to the radiating bodies. The second branch is not intentionally introduced for mutual coupling but rather is representative of existing coupling conditions. That is, the second branch 230 may be an inherent mutual coupling circuit representing the mutual coupling effect, as discussed earlier, between the two radiating bodies of an antenna array. In FIG. 2, the existing inherent electrical coupling of the second branch is represented by a capacitor 235 corresponding to a capacitive air interface. However, it is understood that the existing inherent electrical coupling can correspond to another real, imaginary or complex impedance, for example as modeled by a circuit including capacitors, inductors and/or resistors. Indeed, illustrated embodiments of the present invention include a mutual coupling reduction circuit with both a capacitor and an inductor, which suggests that the existing inherent electrical coupling may be other than a pure capacitive air interface.

In various embodiments, whereas the impedance introduced by the second branch 230 is dictated by aspects such as the antenna array physical topology, the impedance introduced by the mutual coupling reduction circuit 220 is adjustable during the design phase. For a range of given impedances of the first branch, the mutual coupling reduction circuit can thus be configured so as to provide for a parallel resonating circuit with desired characteristics. Embodiments of the present invention comprise tuning of the resonant characteristics of the parallel resonating circuit so as to inhibit mutual coupling between the two radiating bodies 210*a*, 210*b*.

In some embodiments, impedance of the second branch 230 may be determined through modeling, simulation, experimentation, or the like. The impedance of the mutual coupling reduction circuit 220 can then be selected such that the parallel resonant circuit exhibits desired electrical filtering characteristics. The impedance of the mutual coupling reduction circuit may therefore require adjustment based on antenna array characteristics such as antenna spacing, antenna size and shape, operating frequency, location of reflector or ground plane, presence and location of further passive elements, element feed structure, and the like.

In various embodiments, impedance of the second branch is introduced primarily due to near-field coupling between the two radiating bodies, and may predominantly be direct coupling between the two radiating bodies (i.e. a patch-to-patch coupling) rather than coupling via an electromagnetic wave travelling along a surface of the reflector or ground plane parallel to the radiating bodies. Impedance of the second branch may be a function of a variety of coupling routes between radiating bodies.

Figure 3:
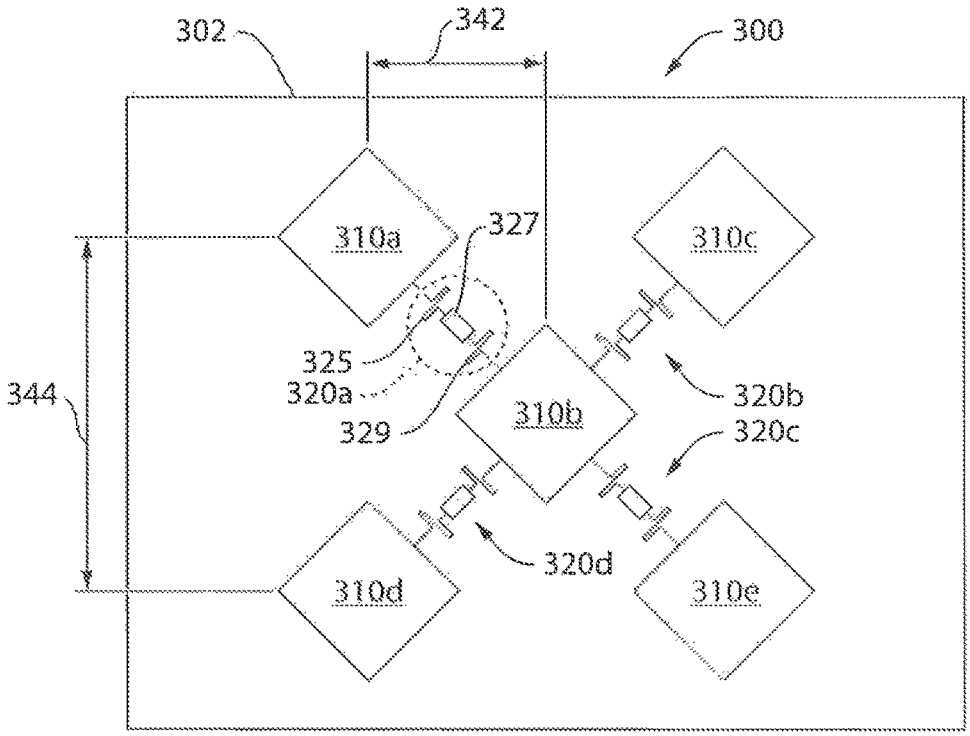
FIG. 3 illustrates a plan view of an antenna array comprising a plurality of mutual coupling reduction circuits formed between coupled antenna elements, according to another embodiment of the present invention.

Referring to FIG. 3, there is shown another embodiment of an antenna array 300 comprising a plurality of antenna elements each including respective radiating bodies 310*a*-310*e* disposed in a symmetrically staggered configuration onto body 302. Similar to radiating bodies 110*a*-110*e* shown in FIG. 1, radiating bodies 310*a*-310*e* are also oriented at a first direction (−45°) and a second direction (+45°), with respect to the vertical edge of the body 302 for polarization in same directions.

Still referring to FIG. 3, a plurality of mutual coupling reduction circuits 320*a*-320*d* comprising series inductor-capacitor-inductor (LCL) circuits each couple adjacent radiating bodies 310*a*-310*e* as follows: a first mutual coupling reduction circuit 320*a* is coupled between first radiating body 310*a* and second radiating body 310*b*, second mutual coupling reduction circuit 320*b* is coupled between second radiating body 310*b* and third radiating body 310*c*, third mutual coupling reduction circuit 320*c* is coupled between second radiating body 310*b* and third radiating body 310*e*, and fourth mutual coupling reduction circuit 320*d* is coupled between second radiating body 310*b* and fourth radiating body 310*d*. Each mutual coupling reduction circuit 320*a*-320*d* is further disposed between respectively coupled radiating bodies 310*a*-310*e*, and oriented in the first direction (−45°) or second direction (+45°) to provide a symmetrical configuration that maintains good cross polarization isolation and discrimination. The mutual coupling reduction circuits 320*a* to 320*d* comprise a capacitor situated between a pair of inductors. For example, circuit 320*a* includes a capacitor 327 formed from a pair of parallel and spaced-apart conductive plates, between two inductors 325, 329 formed from folded lengths of conductor.

Figure 4:
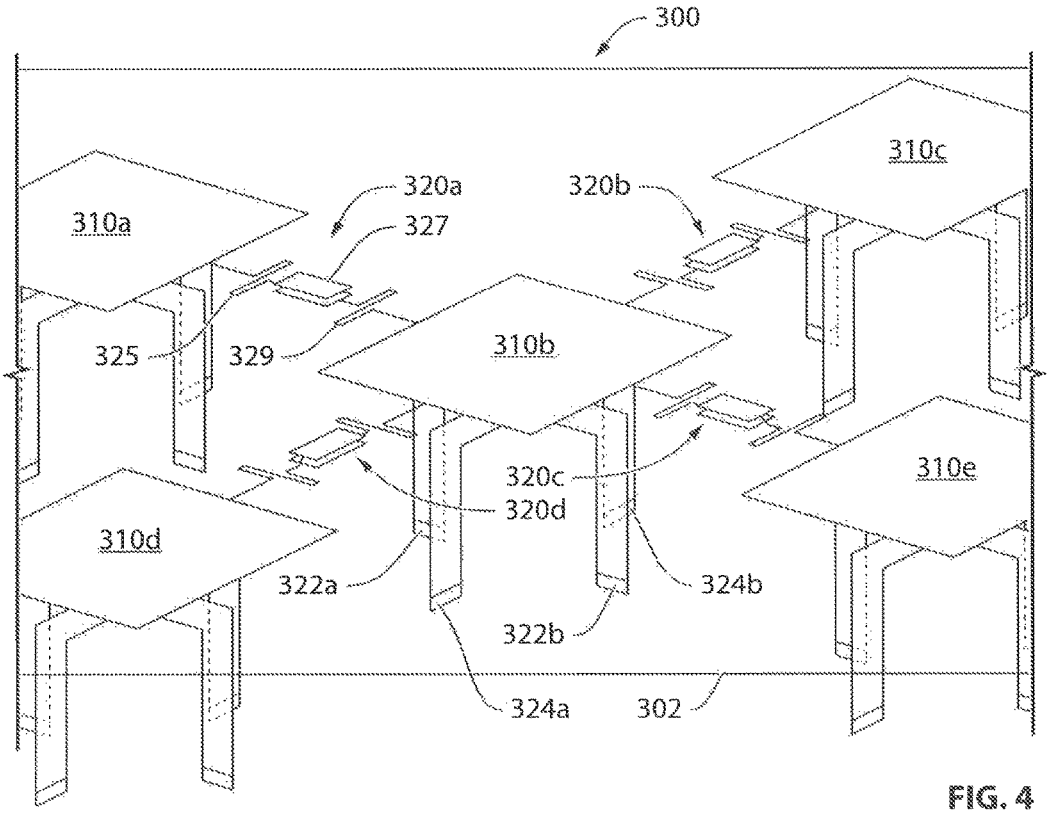
FIG. 4 illustrates a partially transparent perspective view of the antenna array of FIG. 3, illustrating probe feeds coupled to the antenna elements.

Referring to FIG. 4 there is shown a partially transparent perspective view of the antenna array 300 of FIG. 3, in accordance with one embodiment. As shown in FIG. 4, each antenna element further comprises first and second pairs of opposing probes operatively coupled to respective radiating bodies 310*a*-310*e*. For example, second antenna element including second radiating body 310*b* further comprises a first pair of opposing probes 322*a*-322*b*, and a second pair of opposing probes 324*a*-324*b* operatively coupled to the second radiating body 310*b*. The first and second pair of opposing probes 322*a*-322*b*, 324*a*-324*b* provide connection terminals to a transmission or receiving component for operation of the second antenna element in the first and second directions (or polarizations), respectively. The probes may be coupled to transmit and/or receive circuitry for example via an RF front-end.

In other embodiments (not shown), a single probe, or a single set of probes, may be used instead of the first and second pair of opposing probes 322*a*-322*b*, 324*a*-324*b* shown in FIG. 4. Additionally, different types of connection terminals may be used instead of the depicted probes. The number, type, and placement of connection terminals may be modified or altered according to a specific design parameter of the antenna array 300.

Figure 5A:
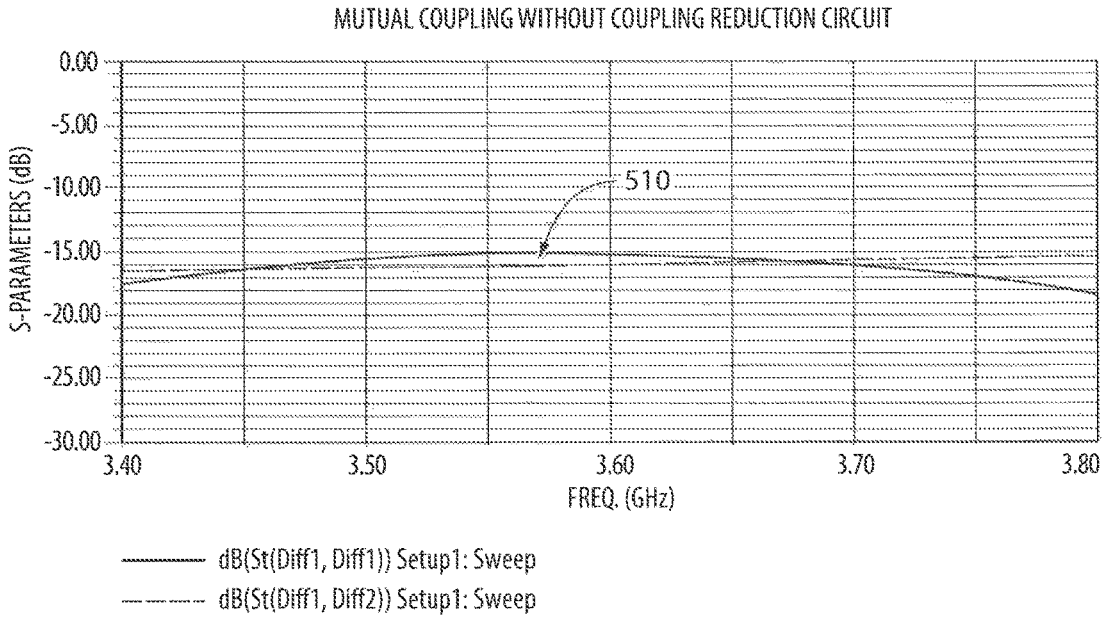
FIG. 5(*a*) is a chart simulating the effect of mutual coupling on the antenna array of FIGS. 3-4 before the inclusion of mutual coupling reduction circuits.
Figure 5B:
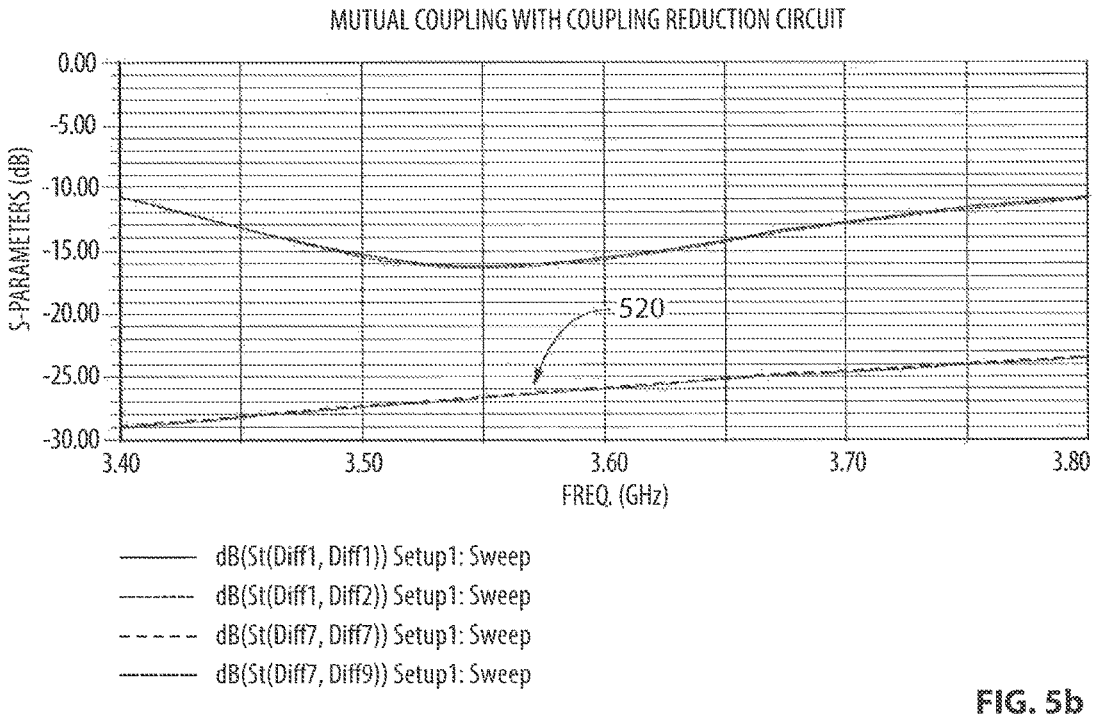

Referring to FIG. 5, there are shown charts simulating the effect of mutual coupling on the antenna array 300 of FIGS. 3-4 before inclusion of the mutual coupling reduction circuits 320*a*-320*d* (FIG. 5(*a*)), and after inclusion of the mutual coupling reduction circuits 320*a*-320*d* (FIG. 5(*b*)) for operating frequencies between 3.4-3.8 Ghz, according to an example embodiment of the present invention. The simulations correspond to the arrangement illustrated in FIG. 3, with an antenna patch size of 29 mm×29 mm, vertical element spacing 344 of 88 mm (144, FIG. 1*a*) and horizontal element spacing 342 of 44 mm. The mutual coupling reduction circuit (320*a* to 320*d*) exhibits a capacitance C of about 100 pF (using a parallel plate capacitance), and an inductance L of about 50 nH. In particular, the $S_{21}$ parameter is illustrated as a first curve 510 in FIG. 5(*a*) and as a second curve 520 in FIG. 5(*b*). As illustrated, the second curve 520 is reduced significantly relative to the first curve 510 over the illustrated frequency range. It is also noted that the second curve 520 slopes downward toward a nominal minimum (or null) located at a resonant frequency of the parallel resonant circuit (not shown at this scale). The other curves in FIGS. 5(*a*) and 5(*b*) illustrate a corresponding $S_{11}$ parameter, that is, a relationship between input and output port of the same antenna. Over the above spectrum of operating frequencies, a simulated reduction of mutual coupling of between about 8 db and about 13 db was observed.

Figure 6A:
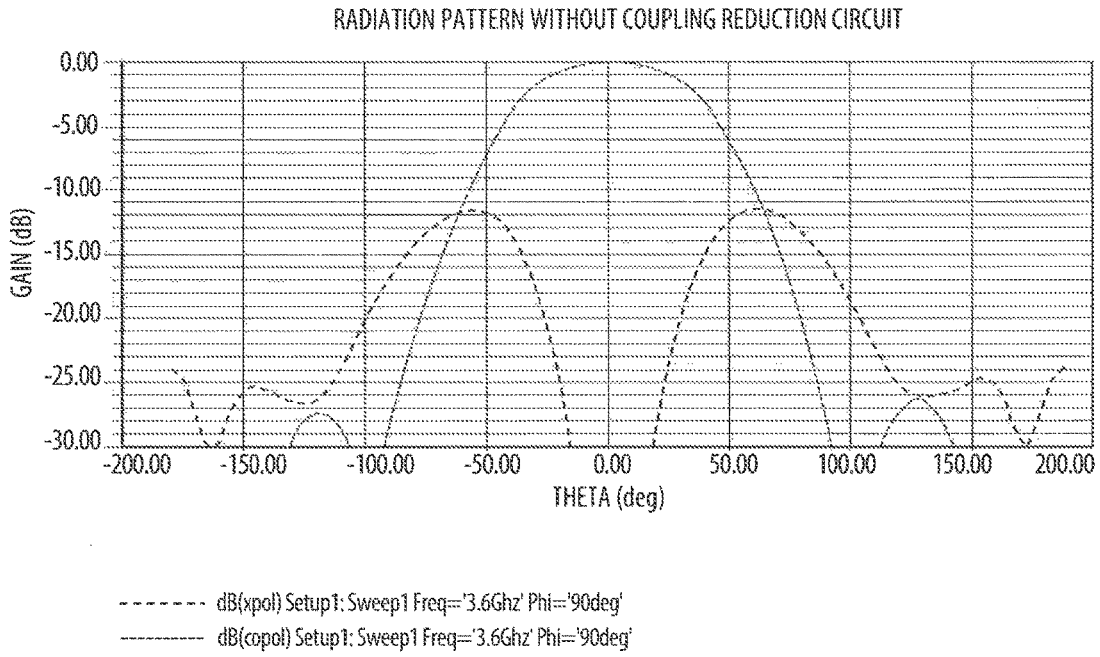
FIG. 6(*a*) is a chart illustrating a simulated azimuth cut of a radiation pattern of the antenna array of FIGS. 3-4 before the inclusion of mutual coupling reduction circuits.
Figure 6B:
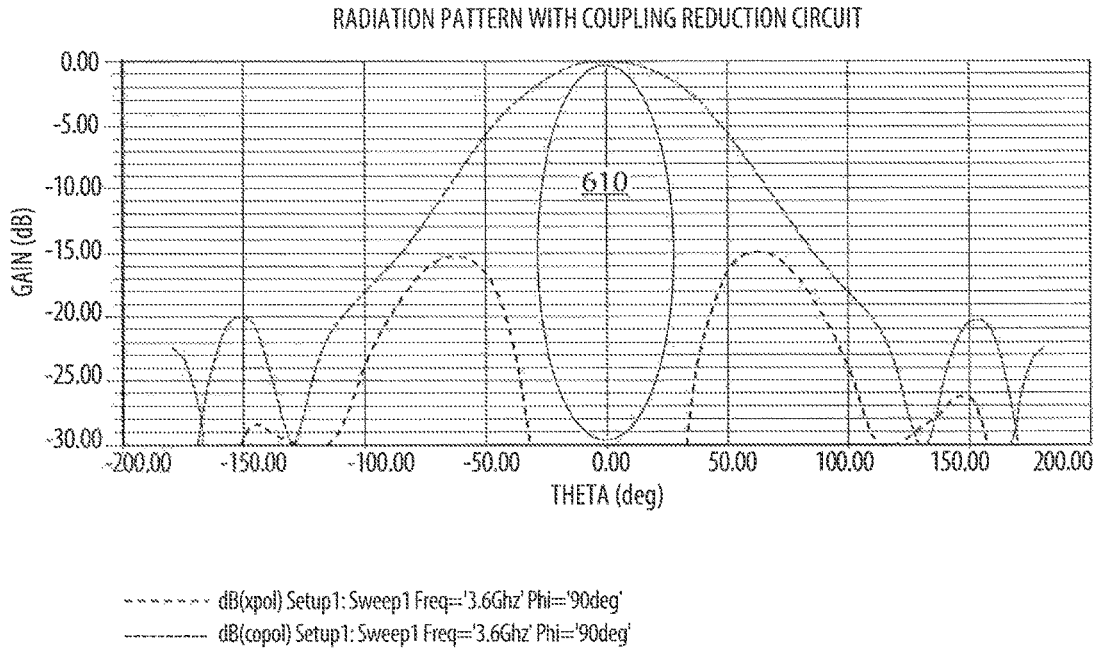

Referring to FIG. 6, there are shown charts simulating an azimuth cut of a radiation pattern of the antenna array 300 of FIGS. 3-4 before inclusion of the mutual coupling reduction circuits 320*a*-320*d* (FIG. 6(*a*)), and after inclusion of the mutual coupling reduction circuits 320*a*-320*d* (FIG. 6(*b*)), according to an embodiment. As shown in FIGS. 6(*a*)-(*b*), the radiation pattern of the antenna array 300 remains substantially similar after inclusion of mutual coupling reduction circuits 320*a*-320*d*, and retains desirably good cross polar discrimination due to the symmetry of the radiating body placement and orientation. The quality of cross polarization discrimination can be identified for example by the existence of the region 610 which shows a separation between the co-polarized radiation pattern and the cross-polarized radiation pattern, in an angular region corresponding to a peak of the co-polarized radiation pattern. Accordingly, embodiments of the present invention are capable of maintaining a similar antenna array radiation pattern and level of cross polarization discrimination, while also reducing the effect of mutual coupling.

FIG. 7(*a*) illustrates an azimuth cut of a simulated radiation pattern of an antenna array, in accordance with an embodiment of the present invention. The antenna array may be used to provide a four-element pattern for application in split-sector beamforming, for example. The radiation pattern is illustrated for the frequency range from about 3.4 GHz to about 3.8 GHz. The radiation pattern illustrates a first peak 710 corresponding to co-polarized operation. The first peak is located at about 25 degrees off of boresight (i.e. −50 degrees). The radiation pattern also illustrates a second peak 720 corresponding to cross-polarized operation.

FIG. 7(*b*) illustrates an antenna array or portion thereof, in accordance with an embodiment of the present invention. A plurality of rectangular patch antenna element radiating bodies are provided, with mutual coupling reduction circuits disposed between adjacent radiating bodies along two diagonal directions relative to the horizontal. The graph of FIG. 7(*a*) corresponds to operation of the four central antenna elements 700*a*, 700*b*, 700*c* and 700*d*, excited as a phased array.

Viewed in a first way, the array of FIG. 7(*b*) comprises a pair of interleaved and diagonally offset grids of antenna elements, each element comprising a rectangular patch rotationally offset at about 45 degrees from horizontal. Viewed in another way, the array of FIG. 7(*b*) corresponds to a collection of rectangular patches arranged in contiguous positions on a portion of a rectangular grid, the entire grid being rotationally offset at about 45 degrees from horizontal. In some embodiments, the patches may be somewhat offset from the rectangular grid, so that the centers of the patches do not necessarily exactly coincide with the intersections of gridlines of the rectangular grid.

By providing mutual coupling reduction circuits 320*a*-320*d* coupled to adjacent radiating bodies 310*a*-310*e*, the antenna array 300 of FIGS. 3 and 4 can potentially reduce the effect of mutual coupling between multiple adjacent radiating bodies 310*a*-310*e*. In other embodiments (not shown), the spacing, number, and orientation of the radiating bodies 310*a*-310*e*, the type, number, and orientation of the mutual coupling reduction circuits 320*a*-320*d*, and the type and number of probes 322*a*, 322*b*, 324*a*, 324*b*, may independently vary in order to meet certain design and performance criteria of the antenna array 300. Mutual coupling reduction circuits may not necessarily be provided between all adjacent antenna element radiating bodies of the array. Rather, a mutual coupling reduction circuit is provided between at least two antenna element radiating bodies, such as between at least two adjacent patch elements.

Mutual coupling reduction circuits between non-adjacent elements are also possible; however the wider spacing between non-adjacent elements may result in a lower inherent mutual coupling, so that such mutual coupling reduction circuits are omitted in various embodiments.

Further, the body (eg. 102, 302 in FIG. 1(*a*) and FIG. 3, respectively), on which radiating bodies are respectively disposed, may comprise a suitable material, such as a dielectric, for supporting the radiating bodies and mutual coupling reduction circuits. In certain embodiments, body corresponds to a layer of a printed circuit board (PCB), upon which the radiating bodies are formed via etching or other suitable technique. A ground plane may be provided on a nearby parallel PCB surface below the body. In various embodiments, the body is a conductive plane. Radiating bodies (eg. 110*a*-110*e*, 310*a*-310*e* in FIG. 1(*a*) and FIG. 3, respectively) may also be disposed on additional layers of the PCB. The mutual coupling reduction circuits may be disposed or at least partially disposed on the additional layers of the PCB. Co-location of the mutual coupling reduction circuit on the same PCB layer as the patch radiating body of the antenna element may facilitate implementation with a relatively low Passive Intermodulation (PIM). The antenna array may thus be provided as a planar array of patch elements in parallel with a ground plane. In various embodiments, the mutual coupling reduction circuit components may be located at least partially within the same plane as the patch elements, although other arrangements may also be used.

In some embodiments, inductors of the mutual coupling reduction circuits may be provided as pattern of folded or spiraled circuit traces within a PCB layer. Capacitors of the mutual coupling reduction circuits may be provided as a pair of parallel plates formed within two adjacent PCB layers, one of which may be located in the same layer as the radiating bodies. In other embodiments, one or more inductors or capacitors may be provided as discrete components soldered to the PCB.

In some embodiments, the mutual coupling reduction circuit may comprise a first set of one or more conductive features extending from a first radiating body and a second set of one or more conductive features extending from a second radiating body. The first set of conductive features and the second set of conductive features extend toward one another. The shape and relative positioning of the conductive features may provide for a desired capacitance and inductance of the mutual coupling reduction circuit. For example, the first and second sets of conductive features may include a set of interleaved "finger-like" protrusions which provide for a desired amount of capacitive coupling.

Figure 8:
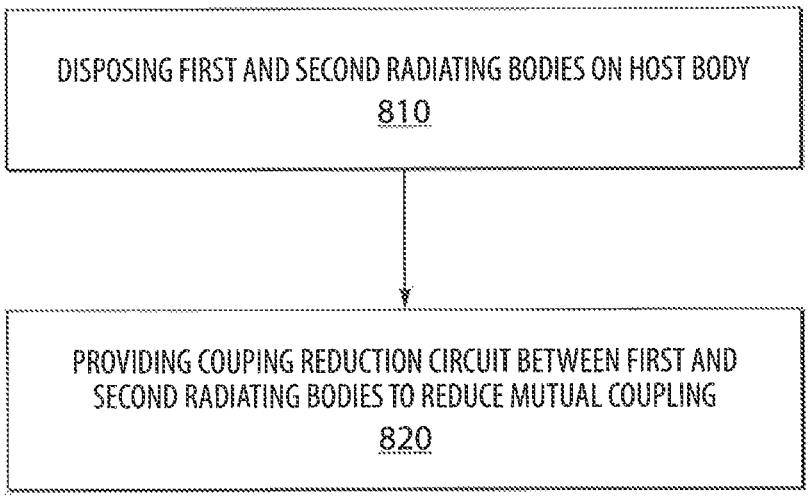
FIG. 8 is a flow chart illustrating a method for manufacturing an antenna array, according to an embodiment.

Referring to FIG. 8, there is shown a flow chart illustrating a method for manufacturing an antenna array, such as that depicted in FIGS. 1-3, and comprising a body, a first antenna element including a first radiating body, a second antenna element including a second radiating body, and a mutual coupling reduction circuit. As shown in FIG. 8, the method comprises:

At step 810: disposing the first and second radiating bodies on the body; and; and At step 820: providing the mutual coupling reduction circuit between the first and second radiating bodies to reduce a mutual coupling effect between the first and second antenna elements.

Embodiments of the disclosed invention provide an antenna array with reduced mutual coupling between adjacent radiating bodies using a mutual coupling reduction circuit coupled in between. In certain embodiments, this may achieve a relatively low mutual coupling by decreasing the interaction between individual antenna elements, thereby permitting narrower spacing between antenna elements in a densely packed antenna array. These features may be of particular importance for full duplex applications, in which mutual coupling between simultaneously transmitting and receiving antenna elements is not desirable. The reduction in mutual coupling may be enhanced in certain embodiments through symmetrical placement and orientation of radiating bodies of the antenna elements.

Embodiments of the present invention provide for an antenna array exhibiting relatively low passive intermodulation (PIM) characteristics. This is due to the potential provision of the mutual coupling reduction circuit within the PCB structure, for example at least partially in the same plane as the resonating bodies and formed of the same material.

Although the present invention has been described with reference to specific features and embodiments thereof, it is evident that various modifications and combinations can be made thereto without departing from the scope of the invention. The specification and drawings are, accordingly, to be regarded simply as an illustration of the invention as defined by the appended claims, and are contemplated to cover any and all modifications, variations, combinations or equivalents that fall within the scope of the present invention.

What is claimed is:

1. An antenna array comprising:

a body;

a first antenna element comprising a first radiating body disposed on the body, the first antenna element centered at a first location on the body;

a second antenna element comprising a second radiating body disposed on the body, the second antenna element centered at a second location on the body which is spaced apart from the first location; and a mutual coupling reduction circuit coupling the first and second radiating bodies to reduce a mutual coupling effect between the first and second antenna elements;

a plurality of additional antenna elements comprising respective additional radiating bodies disposed on the body; and a plurality of additional mutual coupling reduction circuits each coupled between adjacent ones of the additional radiating bodies to reduce mutual coupling therebetween;

wherein the first, second and additional radiating bodies are operable with a polarization oriented in a first direction and are further operable with another polarization oriented in a second direction, and wherein the mutual coupling reduction circuit and the plurality of additional mutual coupling reduction circuits are each coupled between adjacent radiating bodies along the first direction or the second direction.

2. The antenna array of claim 1, wherein the first and second antenna elements are patch antennas, and the first and second radiating bodies are first and second patches of the patch antennas, respectively.

3. The antenna array of claim 2, wherein the first and second patches are rectangular patches having edges oriented along a first direction.

4. The antenna array of claim 3, wherein the first and second patches belong to a plurality of patches arranged in one or more rectangular grid configurations, and the first direction is offset by 45 degrees from a gridline of the one or more rectangular grid configurations.

5. The antenna array of claim 1, wherein the mutual coupling reduction circuit is disposed along a line of symmetry of the antenna array.

6. The antenna array of claim 1, wherein the mutual coupling reduction circuit is electrically parallel to an inherent coupling between the first and second radiating bodies, the mutual coupling reduction circuit and the inherent coupling forming a resonating circuit.

7. The antenna array of claim 6, wherein inherent coupling is a capacitive air interface.

8. The antenna array of claim 1, wherein the mutual coupling reduction circuit comprises an inductor-capacitor (LC) circuit.

9. The antenna array of claim 8, wherein the LC circuit comprises an inductor-capacitor-inductor (LCL) circuit or a capacitor-inductor-capacitor CLC circuit.

10. The antenna array of claim 1, wherein the mutual coupling reduction circuit is tuned to minimize the mutual coupling effect between the first and second antenna elements.

11. The antenna array of claim 1, wherein the first radiating body, the second radiating body, and the additional radiating bodies are arranged on the body in a symmetrically staggered configuration.

12. The antenna array of claim 11, wherein each of the first radiating body, the second radiating body, and the additional radiating bodies are oriented in a first direction.

13. The antenna array of claim 11, wherein adjacent ones of the first radiating body, the second radiating body, and the additional radiating bodies are approximately spaced by a 2:1 elevation to azimuth spacing ratio.

14. The antenna array of claim 11, wherein vertically adjacent ones of the first radiating body, the second radiating body, and the additional radiating bodies are spaced between $0.85\lambda$ to $1.15\lambda$, wherein $\lambda$ is an operating wavelength of the antenna array.

15. The antenna array of claim 11, wherein horizontally adjacent ones of the first radiating body, the second radiating body, and the additional radiating bodies are spaced about $0.5\lambda$, wherein $\lambda$ is an operating wavelength of the antenna array.

16. The antenna array of claim 1, wherein the body comprises a printed circuit board (PCB) layer, and the first antenna element and the second antenna element are disposed on the PCB layer.

17. The antenna array of claim 16, wherein the mutual coupling reduction circuit is also at least partially disposed on the PCB layer.

18. The antenna array of claim 1, wherein the first and second antenna elements further comprise probes for connection to additional components.

19. The antenna array of claim 18, wherein the probes are configured to provide a differential antenna feed.

20. The antenna array of claim 1, further comprising an inherent mutual coupling circuit coupling the first and second radiating bodies, wherein the mutual coupling effect is due to the inherent mutual coupling circuit, and wherein the mutual coupling reduction circuit is configured to inhibit, over a desired bandwidth, the mutual coupling effect.

21. The antenna array of claim 1, wherein the first antenna element is adjacent to the second antenna element, the antenna array further comprising:

a third antenna element of the additional antenna elements, the third antenna element comprising a third radiating body of the additional radiating bodies and disposed on the body, the third radiating body adjacent to the second radiating body;

a second mutual coupling reduction circuit of the additional mutual coupling reduction circuits, the second mutual coupling reduction circuit coupling the second and third radiating bodies to reduce a mutual coupling effect between the second and third antenna elements;

and either or both of:

the third radiating body being separated from the first radiating body by a distance greater than a separation distance between the second radiating body and the first radiating body; and the third radiating body being located away from a line passing through the first radiating body in a plane of the antenna array and extending in a direction of polarization of the first antenna element.

22. The antenna array of claim 21, wherein the second antenna element is associated with the polarization oriented in the first direction and the polarization oriented in the second direction, wherein the first antenna element is aligned with the second antenna element in the first direction, and wherein the third antenna element is aligned with the second antenna element in the second direction.

23. A method for manufacturing an antenna array comprising a body, a first antenna element including a first radiating body, a second antenna element including a second radiating body, a mutual coupling reduction circuit, a plurality of additional antenna elements comprising respective additional radiating bodies, and a plurality of additional mutual coupling reduction circuits, the method comprising:

disposing the first and second radiating bodies on the body, such that the first antenna element is centered at a first location on the body and the second antenna element is centered at a second location on the body which is spaced apart from the first location;

coupling the mutual coupling reduction circuit between the first and second radiating bodies to reduce a mutual coupling effect between the first and second antenna elements;

disposing the additional radiating bodies on the body in a spaced-apart configuration; and coupling each of the plurality of additional mutual coupling reduction circuits between respective adjacent radiating bodies belonging to the first radiating body, the second radiating body, and the additional radiating bodies, to reduce mutual coupling between said adjacent radiating bodies, wherein the first, second and additional radiating bodies are operable with a polarization oriented in a first direction and are further operable with another polarization oriented in a second direction, and wherein the mutual coupling reduction circuit and the plurality of additional mutual coupling reduction circuits are each coupled between said adjacent radiating bodies along the first direction or the second direction.

24. The method of claim 23, further comprising disposing the mutual coupling reduction circuit on the body in between the first and second radiating bodies.

25. The method of claim 23, further comprising disposing the first radiating body, the second radiating body, and the additional radiating bodies on the body with a 2:1 elevation to azimuth spacing ratio.

26. The method of claim 23, further comprising tuning the mutual coupling reduction circuit to minimize the mutual coupling effect between the first and second antenna elements.

* * * * *